US006505690B2

(12) United States Patent
Tokunaga

(10) Patent No.: US 6,505,690 B2
(45) Date of Patent: Jan. 14, 2003

(54) HYDRAULIC UNIT AND ELECTRIC POWER TOOL TO WHICH THE HYDRAULIC UNIT IS INCORPORATED

(75) Inventor: Manabu Tokunaga, Toyoake (JP)

(73) Assignee: Makita Corporation, Anjo (JP)

( * ) Notice: Subject to any disclaimer, the term of this patent is extended or adjusted under 35 U.S.C. 154(b) by 93 days.

(21) Appl. No.: 09/817,539

(22) Filed: Mar. 26, 2001

(65) Prior Publication Data

US 2001/0027871 A1 Oct. 11, 2001

(30) Foreign Application Priority Data

Mar. 30, 2000 (JP) ..... 2000-093218
Jun. 28, 2000 (JP) ..... 2000-195113

(51) Int. Cl.[7] ..... B25B 21/02
(52) U.S. Cl. ..... 173/93.5; 173/93
(58) Field of Search ..... 173/93, 93.5, 93.6, 173/104, 210, 218

(56) References Cited

U.S. PATENT DOCUMENTS 3,556,230 A * 1/1971 Roggenburk ..... 173/93.5
4,836,296 A * 6/1989 Biek ..... 173/93.5
5,080,181 A * 1/1992 Tatsuno ..... 173/93.5
5,611,404 A * 3/1997 Biek et al. ..... 173/93.5
5,704,434 A * 1/1998 Schoeps et al. ..... 173/93.5
5,813,478 A * 9/1998 Kettner ..... 173/93
6,110,045 A * 8/2000 Schoeps ..... 173/93.5

FOREIGN PATENT DOCUMENTS

JP 2718500 11/1997

* cited by examiner

*Primary Examiner*—Scott A. Smith
(74) *Attorney, Agent, or Firm*—Lahive & Cockfield, LLP

(57) ABSTRACT

A hydraulic unit (1) includes a case (2) having an axially slidable top cap (11) at the rear end thereof The hydraulic unit further includes a spindle (17) having communicating holes (28) axially formed therein and a column (19) which is inserted into the case. The column of the spindle includes a through-hole (29) formed therein and is rotatably supported by the top cap's closed-end hole (15). A pair of fluid chambers (25) and another pair of fluid chambers (26) are defined between the case and the spindle. The communicating holes (28) are capable of placing the fluid chambers (25) in communication with a bottom surface (16) of the closed-end hole (15) via the through-hole (29) when the fluid pressure in the fluid chambers (25) reaches or exceeds a threshold. Additionally, a disk spring (30) and a top nut (31) are fitted around the cylindrical connector (13) such that the biasing force of the disk spring presses the top cap toward a liner of the case (2) so as to seal the fluid chambers (25,26) and determine the aforementioned threshold as desired.

15 Claims, 3 Drawing Sheets

HYDRAULIC UNIT AND ELECTRIC POWER TOOL TO WHICH THE HYDRAULIC UNIT IS INCORPORATED

This application claims priority on Japanese Patent Application No. 2000-93218, filed on Mar. 30, 2000 and Japanese Patent Application No. 2000-195113, filed on Jun. 28, 2000, the contents of which are incorporated herein by reference.

BACKGROUND OF THE INVENTION

1. Field of the Invention

The present invention relates to hydraulic units, wherein torque is generated upon the relative rotation of a case and a spindle and communicated instantaneously from the case to the spindle, and to electric power tools, such as impact screwdrivers and other electric tools, to which such hydraulic units are incorporated.

2. Description of the Related Art

A typical hydraulic unit includes a working fluid-filled cylindrical case to which torque from motors and other such apparatuses is transmitted and a spindle which passes through the interior of the case, the shaft of the spindle being supported by closing elements disposed at both ends of the case. The spindle is further provided with blades or other seal bodies/structures protruding radially therefrom so as to circumferentially partition and seal the interior of the case into a plurality of fluid chambers. As the case and spindle are caused to rotate in relation to each other, certain fluid chambers are sealed by the engagement of the blades and ribs or other structures formed in the interior of the case, causing an increase in hydraulic pressure, thereby generating instantaneous torque to the spindle. However, in a hydraulic unit of this design, changes in the temperature in the working fluid result in a change in fluid volume, thus altering the output torque. Japanese Patent No. 2718500 discloses an invention wherein a partitioning wall provided in the interior of a hydraulic unit case forms a low-pressure chamber adjacent to the fluid chamber in the axial direction, and further wherein a spindle is inserted through the partitioning wall, creating very small clearance between this wall and the spindle. Disposed in the interior of the low-pressure chamber is circular piston into which the spindle is loosely inserted, and a biasing force to compress the low-pressure chamber is applied to the piston by a coil spring disposed on the other side of the partitioning wall. This arrangement allows fluctuations in the working fluid volume to be neutralized by the flow of working fluid into and out of the low-pressure chamber, thus stabilizing the output torque.

While this pressure stabilizing mechanism achieves its intended objective, it suffers from certain deficiencies that reduce its utility. In the foregoing mechanism, for example, in addition to the circular piston and coil spring, numerous parts, including the fluid chamber's partitioning wall and seal rings, are required for the formation of the low-pressure chamber, thereby resulting in increased costs and greater size requirements for the hydraulic unit, as it is lengthened in the axial direction.

The same Japanese patent also discloses an arrangement wherein an auxiliary pressure regulating chamber disposed adjacent to the fluid chamber is stopped by a threaded adjustment screw, and further wherein the peak pressure of the fluid chamber, and therefore the maximum output torque, can be changed by making adjustments in the pressure regulating chamber's capacity with the adjustment screw. However, according to this arrangement, the pressure regulating chamber is completely separated from the previously mentioned low-pressure chamber used for stabilizing the output torque. Therefore, provision of both of these arrangements further increases the number of parts required, which also then serves to increase costs. Furthermore, securing required space for the adjustment mechanism places additional limitations on the form of the fluid chamber and other components.

In addition, errors in the maximum output torque of the hydraulic unit as described above may occur when the hydraulic unit is incorporated in an electric power tool, the maximum output torque deviating from initial settings as a result of leakage of the working fluid during use or other causes. Such errors necessitate a laborious process of temporarily removing the hydraulic unit from the electric power tool, adjusting the adjustment screw to adjust the output torque to the proper level, and reinstalling the hydraulic unit in the electric power tool. These disadvantages have a significantly negative effect on the ease in use of the tool.

SUMMARY OF THE INVENTION

In view of the above-identified problems, an important object of the present invention is to provide a hydraulic unit wherein the output torque can be maintained at a stable level while adjustment of the maximum output torque can be performed using a simple process without involving numerous parts.

Another object of the present invention is to provide an electric power tool incorporating the above hydraulic unit that can be manufactured with greater compactness and for which the process of adjusting the maximum output torque can be carried out simply.

The above objects and other related objects are realized by the invention which provides a hydraulic unit comprising a generally cylindrical case containing working fluid, the case having an interior and front and rear closing elements at two axial ends thereof. The hydraulic unit further comprises a spindle which is inserted into the case and includes front and rear ends rotatably supported by the front and rear closing elements, respectively, the spindle further including a plurality of seal bodies for circumferentially partitioning an interior of the case into a plurality of fluid chambers whereby relative rotation between the case and the spindle causes the interior of the case and the seal bodies to seal specified fluid chambers, raising the fluid pressure in specified fluid chambers and generating instantaneous torque to the spindle. In the hydraulic unit, the rear closing element of the case is axially slidably disposed within the case and includes a closed-end hole having a bottom -surface opposing the rear end of the spindle. Moreover, the spindle further includes a fluid channeling passage formed therein for introducing part of the working fluid within the specified fluid chambers to the bottom surface of the closed-end hole, and the hydraulic unit further comprises an elastic member for biasing the rear closing element toward the fluid chambers and an adjustment member for adjusting the biasing force of the elastic member. In the above hydraulic unit, the peak pressure can be maintained and the output torque stabilized at a desired level, even when there is a change in pressure within the fluid chambers resulting from an increase in the temperature of the working fluid. Additionally, the hydraulic unit provides a simplified process for adjustment of its maximum output torque, which can be realized by rotation of the adjustment member that in turn changes the biasing force of the elastic member. In particular, by using the closed-end hole supporting the rear end of the spindle as the portion for accommodating pressure changes while employing the elastic member for both the adjustment and stabilization of output torque, this construction provides a practical arrangement that requires little additional space and permits a reduction in the number of parts used. This both enhances compactness and allows suppression of additional costs.

According to one aspect of the present invention, the elastic member comprises a disk spring disposed at the rear of the rear closing member, and the adjustment member comprises a nut member disposed at the rear of the disk spring and threadably engaged to the case. This feature advantageously reduces the space required in the axial direction and greatly enhancing the compactness of the hydraulic unit.

According to another aspect of the present invention, the case has internal threads on an rear internal surface thereof, and the nut member has external threads so as to engage the internal threads of the case and axially slide relative to the case when rotated, thereby permitting adjustment of the axial position of the nut member and thus the biasing force of the disk spring.

According to still another aspect of the present invention, the rear closing element is a stepped circular member having a large-diameter section in which the closed-end hole is formed and having a reduced-diameter section extending rearward from the large-diameter section. The reduced-diameter section has an inner circular surface and an outer circular surface around which the nut member is axially slidably fitted.

According to yet another aspect of the present invention, the inner surface of the reduced-diameter section defines a second closed-end hole adapted to receive an output shaft coupled to a motor for receiving torque of the motor.

In one feature of the present invention, the rear closing element is slidable between a front position, attained when the fluid pressure in the specified fluid chambers is lower than a threshold, and a rear position, attained when the fluid pressure in the specified fluid chambers reaches or exceeds the threshold. When the rear closing element is in the front position, the large-diameter section abuts rear ends of the seal bodies. Conversely, when the rear closing element is in the rear position, the large-diameter section is detached from the rear ends of the seal bodies as a result of introduction of the working fluid into the closed-end hole via the fluid channeling passage.

In another feature of the present invention, the fluid channeling passage includes a through-hole axially formed through the rear end of the spindle to the closed-end hole and at least one axial communicating hole formed in the spindle. The communicating hole is adapted to be in communication with the fluid chambers at one end thereof and with the through-hole at another end thereof, such that the communicating hole introduces the working fluid into the through-hole when the seal bodies of the spindle are tilted relative to the case during generation of a hydraulic impulse by the hydraulic unit, thus permitting introduction of the working fluid into the closed-end hole when the fluid pressure in the fluid chambers reaches or exceeds the threshold.

In still another feature of the present invention, the threshold corresponds to the biasing force of the disk spring and is selected by adjustment of the disk spring's biasing force.

The invention is further directed to an electric power tool having a housing, a motor, a hydraulic unit as defined above encased in the housing, and an output shaft of the motor for transmitting rotation of the motor to hydraulic unit's spindle via the hydraulic unit's case.

The present invention provides for an electric power tool having a motor, a housing, a hydraulic unit as defined above encased in the housing, and a first spindle for transmitting rotation of the motor to hydraulic unit's spindle via the hydraulic unit's case. The electric power tool includes an adjustment mechanism for preventing rotation of the case in cooperation with an adjusting tool inserted into the electric power tool through the housing while simultaneously permitting operation of the hydraulic unit's adjustment member to adjust the biasing force of the elastic member in cooperation with the adjusting tool. This permits simplified adjustment of the hydraulic unit's maximum torque by insertion of an adjustment tool, eliminating the need to completely remove the hydraulic unit from the housing, make the necessary adjustments, then reassemble the apparatus, thereby affording better adjustment operability and greater convenience in the use of the electric power tool.

In one aspect, the adjustment mechanism includes a plurality of meshing cogs formed on an axial end surface of the nut member and disposed about a circle described about the axis of the nut member, with the meshing cogs being adapted to engage and be rotated by the adjusting tool. The adjustment mechanism additionally includes an insertion hole extending radially along the nut member's end surface from the meshing cogs to an opening formed on an exterior surface of the housing. Further included in the adjustment mechanism is at least one rotation stop section located between the insertion hole and the meshing cogs. The rotation stop section prevents rotation of the case by interfering with the adjusting tool when the adjusting tool is inserted into the insertion hole to engage the meshing cogs.

In another aspect, the nut member includes a nut and a ring disposed at the rear of the nut. The nut has an axial front end surface on which the disk-spring is disposed, whereas the ring is securely connected to the nut so as to integrally rotatable with the nut and having an axial rear end surface on which the meshing cogs are formed.

In a further aspect, the electric power tool further includes a coupling which is connected to the first spindle and disposed between the first spindle and the case of the hydraulic unit for transmitting the torque of the first spindle to the case. The coupling includes, as the at least one rotation stop sections, a plurality of radially extending semicircular grooves formed therein.

In another aspect of the invention, four radially extending semicircular grooves are arranged at regular intervals in an axial front end surface of the coupling where they oppose the meshing cogs.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENTS

Preferred embodiments according to the present invention will be described hereinafter with reference to the attached drawings.

Figure 1A:
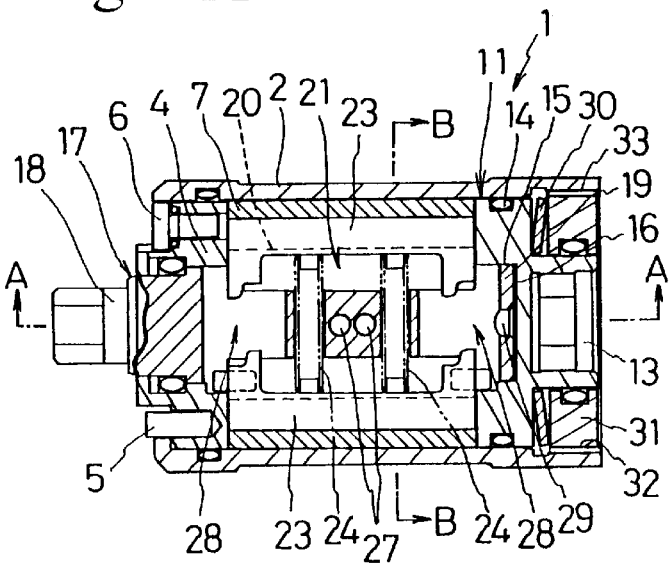
FIG. 1A is a cross-sectional view of a hydraulic unit according to an embodiment of the present invention taken along the axial line.
Figure 1C:
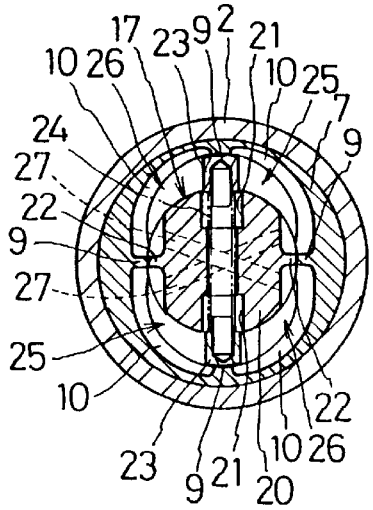
FIG. 1C is a cross-sectional view of the hydraulic unit taken along line B—B in FIG. 1A.
Figure 1B:
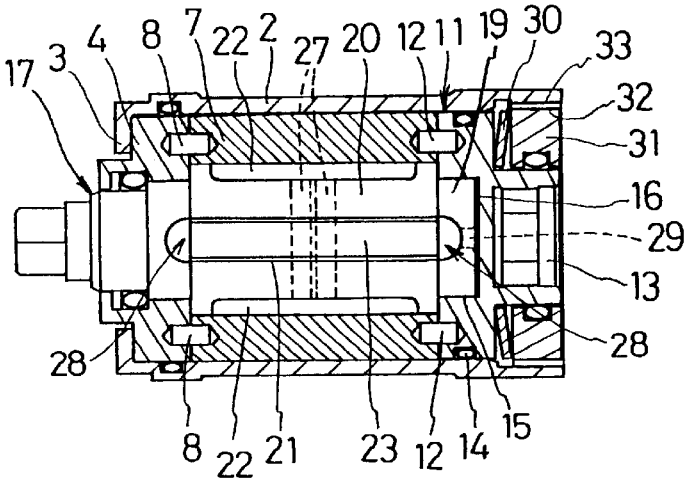
FIG. 1B is a cross-sectional view of the hydraulic unit taken along line A—A in FIG. 1A.

FIG. 1A is a cross-sectional view of a hydraulic unit 1 according to an embodiment of the present invention taken along the axial line, FIG. 1B is a cross-sectional view of the hydraulic unit taken along line A—A in FIG. 1A, and FIG. 1C is a cross-sectional view of the hydraulic unit taken along line B—B in FIG. 1A. The hydraulic unit 1 includes a cylindrical case 2. Plugging the forward part of the cylindrical case 2 (with the front of the case shown as being on the left side of FIG. 1A) from the rear is a closing element such as a disk-shaped bottom cap 4 which is inserted into the cylindrical case 2 and abuts the rear surface of a restrainer 3. A spring pin 5 passes through a gap in the restrainer 3, penetrating the bottom cap 4 so as to rotatably integrate the bottom cap with the case 2. A bolt 6 screwed into the bottom cap 4 provides a passage through which working fluid is supplied. Additionally, a rotatable sleeve-type liner 7 disposed to the rear of the bottom cap 4 is integrally connected to the bottom cap 4 with a plurality of pins 8. The cross section of the interior of the liner 7 presents a generally oblong chamber, with four concave sections 10 formed therein upon partitioning by four axially parallel ribs 9 that radially disposed at regular intervals about the interior surface. In addition, a disk-shaped top cap 11 disposed at the rear of the liner 7 functions as an closing element that is both integrally rotatable with the case and axially movable relative to the case 2 and that is integrated in the rotary direction with the liner 7 by a plurality of pins 12. A substantially cylindrical connector 13 provided with a hexagonal opening protrudes from the rear of the top cap 11, and an O-ring 14 is circumferentially disposed in a groove formed in the rim of the top cap 11.

Disposed at the forward end of a spindle 17 is an output shaft 18 which penetrates the bottom cap 4 and protrudes forward of the case 2 so as to be rotatably supported by the bottom cap. A column 19 is disposed at the rear of the spindle 17 and inserted into and rotatably supported by a circular recess or closed-end hole 15 formed by a depression in the front surface of the top cap 11. The column 19 opposes a bottom surface 16 formed in the closed-end hole 15. Furthermore, formed in the center of the spindle 17 is a large diameter section 20. Provided symmetrically about the spindle's axis in the large diameter section 20 are a pair of accommodating grooves 21 and a pair of axially disposed ribs 22. Furthermore, accommodated in each groove 21 is a blade 23 that is slightly circumferentially tiltable. Two coil springs 24 penetrating the spindle 17 bias the blades 23 outwardly in mutually opposing directions such that the outer edges of the blades 23 come into abutment with the interior surface of the liner 7. Thus, the interior of the liner 7 is divided by the blades 23 into two partitions. When the spindle 17 is in the rotated position shown in FIG. 1C, the contact between the blades 23 and ribs 22 (the seal bodies or portions of the spindle 17) and the four liner ribs 9 (the seal bodies or portions of the liner 7) results in the formation of four well-sealed fluid chambers 25 and 26 in the fluid-filled or fluid-containing interior of the liner 7. However, disposed in the center portion of the spindle 17 are intersecting connecting passages 27 which provide mutual communication between the diametrically symmetrical pairs of fluid chambers 25 and 26.

Meanwhile, the accommodating grooves 21 of the spindle 17 are placed in mutual communication by communicating holes 28 formed front to back in the axial direction of the spindle 17. Depending on the angle of tilt of the blade 23, the gap created between the side of each blade and the accommodating groove 21 due to such tilting allows communication between the fluid chambers 25 or 26. Additionally, a through-hole 29 is formed in and coaxial with the column 19 of the spindle 17, placing the closed-end hole 15 of the top cap 11, by which the column 19 is supported, in communication with the rear communicating hole 28. The communicating hole 28 and the through-hole 29 form a passage for channeling the working fluid in the fluid chambers 25 and 26 to the closed-end hole 15.

Furthermore, fitted on the connector 13 of the top cap 11 from its rear are an elastic element such as a disk spring 30 and an adjustment member such as a top nut 31. The externally threaded portion 32 formed about the top nut 31 is screwed into the internally threaded portion 33 formed in the interior surface of the case 2 such that by rotating the top nut 31 so as to cause the screw to travel in the forward direction, the biasing force of the disk spring 30 presses the top cap 11 against the rear of the liner 7, enabling closure of each of the fluid chambers 25 and 26.

When a hydraulic unit 1 thus constructed is incorporated in an electric power tool such as an impact wrench or impact screwdriver driven by a motor, the connector 13 of the top cap 11 is coupled to the output shaft which is in turn coupled to the tool's motor for receiving torque from the motor, and a chuck or other mechanism for retention of the bit is provided at the end of the spindle 17, i.e., the output shaft 18. Thus, when the top cap 11 rotates with the rotation of the output shaft coupled to the motor, the liner 7 and case 2 which are integrated with the top cap 11 in the radial direction also rotate (rotation is counterclockwise in FIG. 1C). Due to the relative rotation between the liner 7 and the spindle 17, the leading edges of the blades 23 slide on the inner surface of the liner 7 while tilted in the direction of rotation of the case 2, whereas the blades 23 and ribs 22 of the spindle 17 and the ribs 9 of the liner 7 act to seal the fluid chambers 25, raising the pressure in each of the fluid chambers 25, instantaneously increasing the torque outputted to the spindle 17 via the blades 23, thus causing the spindle 17 to rotate (generation of hydraulic impulse). Repetition of this hydraulic impulse enables tightening of a screw or other task to be performed. Furthermore, since the tilting of the blades 23 accompanying the generation of such hydraulic impulses brings the fluid chambers 25 into communication with the communicating holes 28 formed in the spindle 17, the hydraulic pressure from the communicating holes 28 brought to bear at the through-hole 29 are applied to the bottom surface 16 of the closed-end hole 15 of the top cap 11.

Figure 2:
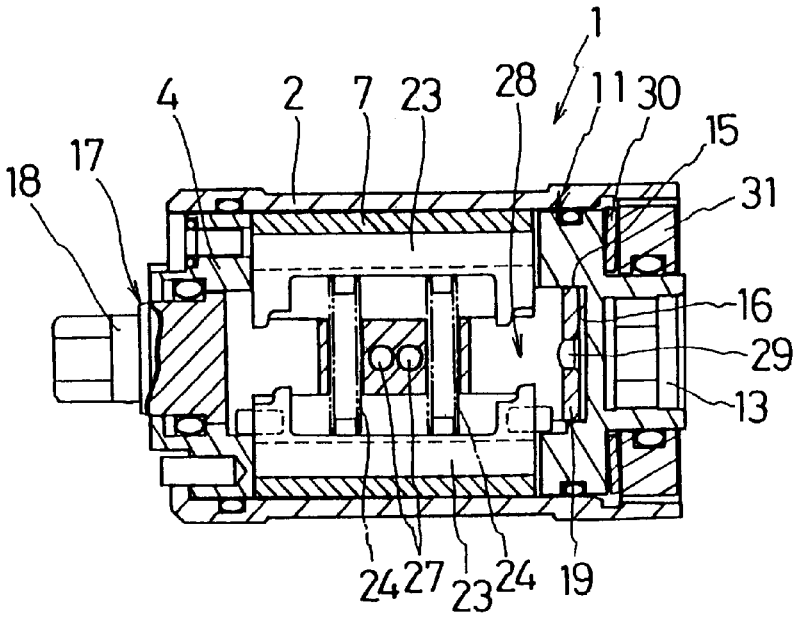
FIG. 2 is a cross-sectional view of the hydraulic unit of FIG. 1 showing the top cap in the retracted position.

A rise in the temperature of the working fluid within the liner 7 also results from the operation of the hydraulic unit 1, which accordingly produces a change in the volume of the working fluid. This can have the undesirable effect of causing fluctuations in output torque as hydraulic pulses are generated. In this embodiment, the top cap 11 is capable of sliding along the axis, which, due to the biasing force on the liner 7 from the disk spring 30, maintains the seal for the fluid chambers 25 and 26. However, when the pressure within the fluid chambers 25 exceeds the peak pressure for the fluid chambers 25 as determined by the biasing force of the disk spring 30, the hydraulic pressure on the bottom surface 16 of the closed-end hole 15 in the top cap 11 through the through-hole 29 causes working fluid to flow to the interior of the closed-end hole 15, which, as shown in FIG. 2, causes the top cap 11 to recede, overcoming the biasing force of the disk spring 30. Thus, the seal at the rear of the fluid chambers 25 and 26 is undone, such that the adjoining fluid chambers 25 and 26 are placed in communication with each other at the rear extremities of the blades 23. As this decreases the pressure within the fluid chambers 25, then, as shown in FIG. 1A, the top cap 11 moves forward due to the biasing force of the disk spring 30, and the working fluid in the closed-end hole 15 returns to the communicating holes 28, sealing the fluid chambers 25 and 26. In this manner, excessive pressure in the fluid chambers 25 is relieved by the sliding of the top cap 11, stabilizing the peak pressure and allowing generation of hydraulic pulses with a fixed, constant output torque.

On the other hand, when adjusting the maximum output torque of the hydraulic unit 1, the top nut 31 is rotated, thus causing the top nut 31 to travel forward or backward within the case 2 along the axis as it is screwed. This alters the biasing force of the disk spring 30, thereby permitting the peak pressure used for drawing back the top cap 11 to be selected as desired. Thus, even in situations such as when there is a reduction in working fluid used, adjustment of the biasing force of the disk spring 30 with the top nut 31 makes it possible to maintain the peak pressure at a fixed level.

With a hydraulic unit so constructed, even when there is a change in pressure within the fluid chambers 25 and 26 due to an increase in working fluid temperature, the peak pressure is maintained, thus allowing the output torque to be advantageously stabilized at the desired level. In addition, the adjustment of maximum output torque can be realized by a change in the biasing force of the disk spring 30 effected by the rotation of the top nut 31, thus allowing a simplified adjustment operation as well. In particular, this construction utilizes the closed-end hole 15 supporting the rear extremity or end of the spindle 17 as the chamber used for accommodating pressure, while simultaneously using the disk spring 30 both for stabilization and adjustment of output torque. This results in an advantageous design that requires no additional space and further reduces the number of component parts, thereby imposing no additional limitations on the form of the liner, fluid chambers, and other components. Thus, even with the inclusion of such a mechanism for the adjustment of the output torque, this construction provides for effective realization of further compactness as well as suppression of increased costs.

Additionally, the use of the disk spring 30 as the elastic element and the top nut 31 as the adjustment member provides a solution that provides even further compactness of the hydraulic unit 1 by minimization of required space in the axial direction.

Furthermore, if space considerations are not an issue, a coil spring may alternatively be used as an elastic element, for example in the concave section accommodating the top nut and top cap spring. Further in regard to the passage provided at the spindle's end portion that is used for channeling working fluid, instead of being borne only by the communicating holes 28 and through-hole 29 as in the above construction, the provision of a plurality of holes and other design changes may be adopted insofar as the pressure can be evenly applied to the bottom surface of the closed-end hole.

Additionally, in regard to the physical construction of the hydraulic unit, the present invention is not limited to a hydraulic unit as in the above-described embodiment, but is applicable to other structures, for example a hydraulic unit in which no liner is provided and in which the ribs are disposed directly on the interior surface of the case, or in another example, a hydraulic unit in which only one blade is provided.

Electric Power Tool Incorporating the Hydraulic Unit

Errors in setting of the maximum output torque that has been set by rotating the top nut 31 still may occur due to leakage of working fluid or other problems resulting from use of the hydraulic unit described above. Thus, a structure for an electric power tool wherein the adjustments with the top nut 31 can be made easily in such cases is described in the following. This structure is described hereinafter with reference to the attached drawings, in which identical or similar reference numerals or characters denote identical or similar parts or elements throughout the several views. Therefore, description of such elements is omitted.

Figure 3:
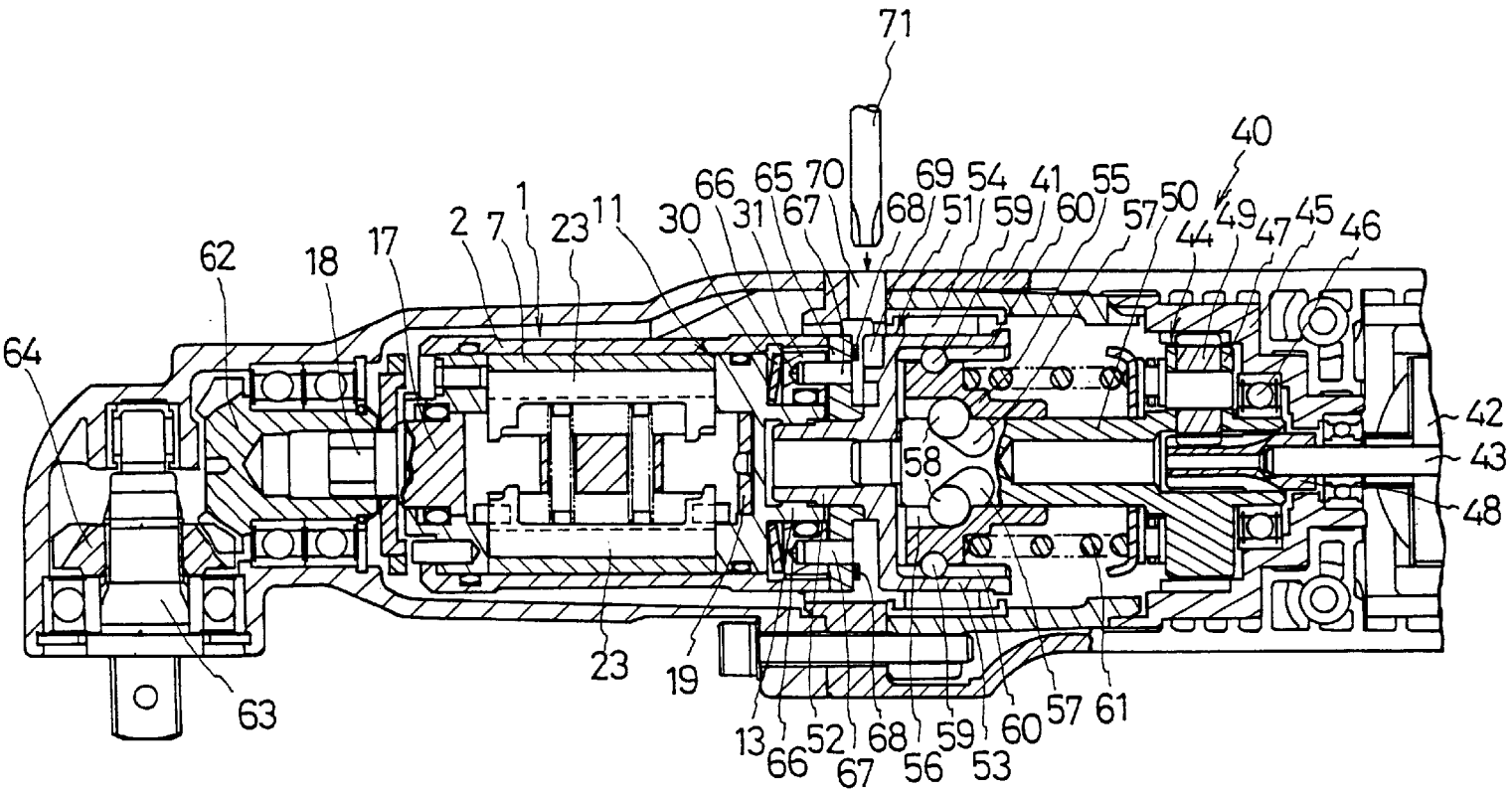
FIG. 3 is a cross-sectional view of an soft impact angle wrench incorporating the hydraulic unit shown in FIG. 1.

FIG. 3 is a cross-sectional view of a soft impact angle wrench 40 in accordance with the present invention, shown with part of its casing removed to expose internal mechanisms. Provided at the rear of the interior of the housing 41 of the angle wrench is a motor 42, with an epicycle reduction unit 44 disposed forward of the motor 42. In the epicycle reduction unit 44, a carrier 47 is supported rotatably by ball bearings 46 disposed in a gear housing 45 mounted within the housing 41, encasing a pinion 48 affixed to the output shaft 43 of the motor 42. The carrier 47 causes a plurality of rotatably supported planetary gears 49 to engage the pinion 48, whereby a first spindle 50 coaxial with the output shaft 43 are extended forward of the carrier 47.

Furthermore, the tip of the first spindle 50 is inserted in the small cylinder 52 of a stepped cylindrical coupling 51 which is supported in the housing 41 by a needle bearing 54 disposed therein, and which is loosely inserted in a hammer 55 provided within the cup 53 at the rear of the coupling 51. The first spindle 50 and the hammer 55 are integrated in the rotary direction by balls 58 which are spanned and coupled by grooves 56 formed by depressions made in the axial direction of the inner surface of the hammer 55 and V-shaped cam grooves 57 formed by depressions made in the circumferential surface of the first spindle 50. However, as bans 59 inserted in the outer surface of the hammer 55 are integrated in the rotary direction with the coupling 51 via connecting grooves 60 formed by depressions made in the axial direction of the inner surface of the cup 53 of the coupling 51, the first spindle 50 thus rotates together with the coupling 51 via the hammer 55. A coil spring 61 disposed between the hammer 55 and the balls 58 biases the hammer 55 forward and positions the balls 58 at the rear extremity of the grooves 56 and the top ends of the cam grooves 57.

Thus, the hydraulic unit 1 is disposed forward of the coupling 51 within the housing 41 along the same axis as the coupling 51, and the small cylinder 52 of the coupling 51 is connected to the connector 13 of the top cap 13 so as to allow integrated rotation with the top cap 1. Meanwhile, the output shaft 18, which is connected at its rear end to the spindle 17 of the hydraulic unit 1, is connected at its front end to a coaxial bevel gear 62 rotatably supported within the forward part of the housing 41 so as to allow integrated rotation of the shaft 18 with the bevel gear 62. This bevel gear 62 engages another bevel gear 64 that is integrally formed with an rotatably supported second spindle 63 that is orthogonally oriented to the spindle 17 and supported at the front end of the housing 41, thus constituting a structure which allows the torque of the spindle 17 to be transmitted orthogonally to the second spindle 63.

Furthermore, an adjustment ring 65 is disposed on the rear surface of the top nut 31 of the hydraulic unit 1. This adjustment ring 65 is connected to and integrally rotatable with the top nut 31 via a plurality of pins 67 that are inserted into receiving holes 66 formed in the rear end surface of the top nut 31. Disposed in the rear end surface of the adjustment ring 65 are meshing teeth or cogs 68 which protrude about a circle centered on the axis of the adjustment ring 65. Meanwhile, semicircular rotation-stop grooves 69 are formed radially at four evenly situated positions in the front end surface of the cup 53 of the coupling 51 opposing the meshing cogs 68 in a circle centered about the same axis.

Furthermore, formed in the housing 41 is an insertion hole 70 that extends radially along the line lying through the axis of the first spindle 50 and passing between the meshing cogs 68 and the grooves 69. The insertion hole terminates at an opening in the housing 41, thus constituting an adjustment mechanism wherein upon insertion of an adjustment tool 71 in the insertion hole 70, the rear face of the adjustment tool 71 engages one of the grooves 69 in the coupling 51, while the front engages the meshing cogs 68 of the adjustment ring 65.

In a soft impact angle wrench 40 thus constructed, activation of the motor 42 causes the first spindle 50 to rotate with reduced torque via the epicycle reduction unit 44 interposed therebetween. As the hammer 55, the coupling 51, and the hydraulic unit 1 integrally rotate with the first spindle 50, the spindle 17 of the hydraulic unit 1 causes rotation of the second spindle 63 via the bevel gears 62 and 64, thus allowing tightening of a bolt or other work to be performed. Furthermore, with an increase in the load on the second spindle 63 accompanying such a tightening operation, the hydraulic unit 1 generates hydraulic pulses as previously described, and the resulting impact allows further tightening to occur.

Upon generation of such hydraulic impulses, a difference in speed develops between the first spindle 50, which tends to continue rotating at the same speed, and the hydraulic unit 1, the coupling 51, and the hammer 55, which tend to rotate more slowly with the second spindle 63 now operating at a reduced rotational speed. However, each of the balls 58 disposed between the first spindle 50 and the hammer 55 moves rearward along the slanted groove portions of the cam grooves 57, thus pushing the hammer 55 in the rearward direction against the biasing force of the coil spring 61. This permits free rotation of the first spindle 50 so as to eliminate the aforementioned difference. When the difference is eliminated upon generation of hydraulic impulses, the biasing force of the coil spring 61 moves the hammer 55 forward while the balls 58 move forward along the slanted groove portions of the cam grooves 57 so as to be restored to the positions shown in FIG. 3, i.e., the top ends of the respective cam grooves 57.

As seen from the above, the retraction of the hammer 55 and the free rotation of the spindle 11 according to this embodiment cushion the impact from the generation of hydraulic impulses, thereby preventing transmission of recoil to the epicycle reduction unit 44 and the motor 42. This minimizes wear on the gears and prevents burning out of the motor 52 while improving both the durability of the soft impact angle wrench 40 and the degree of comfort experienced by the operator in using the tool.

If, during operation of the soft impact angle wrench 40, the maximum torque deviates from the initial setting due to leakage of working fluid on the hydraulic unit 1 or other causes, the adjustment tool 71 is inserted in the insertion hole 70, wherein it engages one of the grooves 69. This prevents rotation of the coupling 51 while simultaneously preventing rotation of the case 2 of the hydraulic unit 1. When-in this condition the adjustment tool 71 is rotated, the adjustment ring 65 is then made to rotate via the meshing cogs 68. The top nut 31 integrally connected with the adjustment ring 65 also rotates, causing forward travel of the top nut 31 within the case 2 as it is screwed into the case 2, thereby changing the biasing force of the disk spring 30 and altering the maximum output torque of the hydraulic unit 1. In this manner, deviation of the maximum output torque can thus be corrected to a proper value.

In the above-described soft impact angle wrench 40, employment of the adjustment mechanism comprising the meshing cogs 68 formed in the adjustment ring 65, the grooves 69 formed in the coupling 51, and the insertion hole 70 formed in the housing 41 permits adjustment of the maximum output torque of the hydraulic unit 1 to be carried out simply by insertion of the adjustment tool 71, eliminating the need to completely remove the hydraulic unit 1 from the housing 41, make the necessary adjustments, then reassemble the apparatus. This affords better operability for adjustment of torque and greater convenience in using the tool. In particular, use of the meshing cogs 68, grooves 69, and insertion hole 70 as the adjustment mechanism and the top nut 31 as the adjustment member provides a design whereby the adjustment mechanism can be constructed simply.

Furthermore, in the soft impact angle wrench according to this embodiment, although the meshing cogs 68 are formed separately on the top nut 31 through the use of the adjustment ring 65, such teeth or cogs may also be formed directly on the rear surface of the top nut 31, without the use of the adjustment ring 65. This would allow a simplified design as a reduced number of part can be realized.

Additionally, in this case, although the grooves 69 used for stopping rotation of the case 2 are provided in the coupling 51, an alternative design is possible wherein the rear end of the case 2 in the hydraulic unit 1 may be extended, and notches, gaps or holes may be provided to allow the adjustment tool 71 to pass through, with rotation of the case being stopped when the adjustment tool 71 is inserted into one of the notches, gaps or other passageways.

Still further, although the above embodiment describes the construction of a soft impact angle wrench wherein communication between the first spindle 50 and the hydraulic unit 1 is accomplished via the hammer 55 and coupling 51, if there is no problem of differences in speed occurring due to generation of hydraulic pulses, then an arrangement wherein the first spindle 50 is directly connected to the top cap 11 of the hydraulic unit 1 can be easily realized. Naturally, this may also be used in an electric power tool in which the second spindle is omitted and the hydraulic unit's spindle is used as the output shaft without further modification.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by letters patent is:

1. A hydraulic unit comprising, a generally cylindrical case containing working fluid, the case having an interior and front and rear closing elements at two axial ends thereof, and a spindle which is inserted into the case and includes front and rear ends rotatably supported by the front and rear closing elements, respectively, the spindle further including a plurality of seal bodies for circumferentially partitioning an interior of the case into a plurality of fluid chambers whereby relative rotation between the case and the spindle causes the interior of the case and the seal bodies to seal specified fluid chambers, raising the fluid pressure in specified fluid chambers and generating instantaneous torque to the spindle, wherein the rear closing element of the case is axially slidably disposed within the case and includes a closed-end hole having a bottom surface opposing the rear end of the spindle, and wherein the spindle further includes a fluid channeling passage formed therein for introducing part of the working fluid within the specified fluid chambers to the bottom surface of the closed-end hole, the hydraulic unit further comprising an elastic member for biasing the rear closing element toward the fluid chambers and an adjustment member for adjusting the biasing force of the elastic member.

2. A hydraulic unit as set forth in claim 1, wherein the elastic member comprises a disk spring disposed at the rear of the rear closing member, and the adjustment member comprises a nut member disposed at the rear of the disk spring and threadably engaged to the case.

3. A hydraulic unit as set forth in claim 2, wherein the case has internal threads on an rear internal surface thereof, and the nut member has external threads so as to engage the internal threads of the case and axially slide relative to the case when rotated, thereby permitting adjustment of the axial position of the nut member and thus the biasing force of the disk spring.

4. A hydraulic unit as set forth in claim 3, wherein the inner surface of the reduced-diameter section defines a second closed-end hole adapted to receive an output shaft coupled to a motor for receiving torque of the motor.

5. A hydraulic unit as set forth in claim 3, wherein the rear closing element is slidable between a front position, attained when the fluid pressure in the specified fluid chambers is lower than a threshold, in which the large-diameter section abuts rear ends of the seal bodies, and a rear position, attained when the fluid pressure in the specified fluid chambers reaches or exceeds the threshold, in which the large-diameter section is detached from the rear ends of the seal bodies as a result of introduction of the working fluid into the closed-end hole via the fluid channeling passage.

6. A hydraulic unit as set forth in claim 5, wherein the threshold corresponds to the biasing force of the disk spring and is selected by adjustment of the biasing force of the disk spring.

7. A hydraulic unit as set forth in claim 2, wherein the rear closing element is a stepped circular member having a large-diameter section in which the closed-end hole is formed and having a reduced-diameter section extending rearward from the large-diameter section, the reduced-diameter section having an inner circular surface and an outer circular surface around which the nut member is axially slidably fitted.

8. An electric power tool having a motor, a housing, the hydraulic unit as set forth in claim 2 encased in the housing, and a first spindle for transmitting rotation of the motor to the spindle of the hydraulic unit via the case of the hydraulic unit, the power tool comprising an adjustment mechanism for preventing rotation of the case in cooperation with an adjusting tool inserted into the electric power tool through the housing while simultaneously permitting operation of the nut member of the hydraulic unit to adjust the biasing force of the elastic member in cooperation with the adjusting tool.

9. An electric power tool as set forth in claim 8, wherein the adjustment mechanism comprises meshing cogs formed on an axial end surface of the nut member and disposed about a circle centered on the axis of the nut member, the meshing cogs being adapted to engage and be rotated by the adjusting tool, an insertion hole extending radially along the end surface of the nut member from the meshing cogs to an opening formed on an exterior surface of the housing, and at least one rotation stop section located between the insertion hole and the meshing cogs, the rotation stop section preventing rotation of the case by interfering with the adjusting tool when the adjusting tool is inserted into the insertion hole to engage the meshing cogs.

10. An electric power tool as set forth in claim 9, further comprising a coupling which is connected to the first spindle and disposed between the first spindle and the case of the hydraulic unit for transmitting the torque of the first spindle to the case, the coupling including, as the at least one rotation stop sections, a plurality of radially extending semicircular grooves formed therein.

11. An electric power tool as set forth in claim 10, wherein four radially extending semicircular grooves are arranged at regular intervals in an axial front end surface of the coupling where they oppose the meshing cogs.

12. An electric power tool as set forth in claim 8, wherein the nut member includes a nut and a ring disposed at the rear of the nut, the nut having an axial front end surface on which the disk-spring is disposed, and the ring being securely connected to the nut so as to integrally rotatable with the nut and having an axial rear end surface on which the meshing cogs are formed.

13. A hydraulic unit as set forth in claim 1 or 5, wherein the fluid channeling passage includes a through-hole axially formed through the rear end of the spindle to the closed-end hole and at least one axial communicating hole formed in the spindle, the communicating hole adapted to be in communication with the fluid chambers at one end thereof and with the through-hole at another end thereof, such that the communicating hole introduces the working fluid into the through-hole when the seal bodies of the spindle are tilted relative to the case during generation of a hydraulic impulse by the hydraulic unit, thus permitting introduction of the working fluid into the closed-end hole when the fluid pressure in the fluid chambers reaches or exceeds the threshold.

14. An electric power tool having a housing, a motor, the hydraulic unit as set forth in claim 1 encased in the housing, and an output shaft of the motor for transmitting rotation of the motor to the spindle of the hydraulic unit via the case of the hydraulic unit.

15. An electric power tool having a motor, a housing, the hydraulic unit as set forth in claim 1 encased in the housing, and a first spindle for transmitting rotation of the motor to the spindle of the hydraulic unit via the case of the hydraulic unit, the electric power tool comprising an adjustment mechanism for preventing rotation of the case in cooperation with an adjusting tool inserted into the electric power tool through the housing while simultaneously permitting operation of the adjustment member of the hydraulic unit to adjust the biasing force of the elastic member in cooperation with the adjusting tool.

* * * * *

UNITED STATES PATENT AND TRADEMARK OFFICE

CERTIFICATE OF CORRECTION

PATENT NO. : 6,505,690 B2
DATED : January 14, 2003
INVENTOR(S) : Tokunaga

It is certified that error appears in the above-identified patent and that said Letters Patent is hereby corrected as shown below:

Title page,
Item [57], ABSTRACT,
Line 2, replace “thereof The hydraulic” with -- thereof. The hydraulic”;

Column 2,
Line 50, replace “a bottom –surface” with -- a bottom surface --;

Column 8,
Line 45, replace “as bans 59” with -- as balls 59 --;

Column 10,
Line 5, replace “When-in this” with -- When in this --;

Column 12,
Line 49, replace “in claim 1 or 5, wherein” with -- in claim 1, wherein --;

Signed and Sealed this

Twenty-seventh Day of April, 2004

JON W. DUDAS
*Acting Director of the United States Patent and Trademark Office*